US006314905B1

(12) United States Patent
Herbein et al.

(10) Patent No.: US 6,314,905 B1
(45) Date of Patent: Nov. 13, 2001

(54) BOAT MANUFACTURED FROM FORMABLE ALUMINUM

(75) Inventors: William C. Herbein, Murrysville, PA (US); Daniel D. Roup, Davenport, IL (US); Robert B. Whitesides, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 0 days.

(21) Appl. No.: 09/671,047

(22) Filed: Sep. 27, 2000

Related U.S. Application Data

(63) Continuation-in-part of application No. 09/186,828, filed on Nov. 5, 1998, now Pat. No. 6,145,466.
(60) Provisional application No. 60/064,253, filed on Nov. 4, 1997.

(51) Int. Cl.[7] ..... B63B 3/00
(52) U.S. Cl. ..... 114/356; 114/357
(58) Field of Search ..... 114/355, 356, 114/357

(56) References Cited

U.S. PATENT DOCUMENTS

| | | | |
|---|---|---|---|
| 3,237,219 | 3/1966 | Johnson et al. | 114/356 |
| 5,349,917 | 9/1994 | May | 114/356 |
| 5,676,080 | 10/1997 | Allen | 114/356 |

*Primary Examiner*—Stephen Avila
(74) *Attorney, Agent, or Firm*—Charles Q. Buckwalter; Julie W. Meder; Edward L. Levine

(57) ABSTRACT

A single hull or doubled hull boat manufactured from stretch formed aluminum alloy. Alloys of the AA 6000 series alloys are particularly suited for forming of small to medium sized water vessels.

10 Claims, 3 Drawing Sheets

BOAT MANUFACTURED FROM FORMABLE ALUMINUM

CROSS REFERENCE TO RELATED APPLICATIONS

This application is a continuation-in-part of U.S. Ser. No. 09/186,828, filed Nov. 5, 1998, now U.S. Pat. No. 6,145,466, and claims the benefit of U.S. Ser. No. 60/064,253, filed Nov. 4, 1997.

FIELD OF THE INVENTION

The present invention is directed to small to medium sized water craft manufactured from formable aluminum alloys especially those comprising the 6000 series aluminum alloys as designated by the Aluminum Association.

BACKGROUND OF THE INVENTION

The manufacture of boats from aluminum is old in the boat building business. Aluminum is found to be a useful resource for water vehicles because it is light-weight, strong, and weatherable. Neither salt nor fresh bodies of water have much impact on the durability of aluminum, thereby making aluminum a preferred material over iron-based materials, such as steel, the added weight of steel notwithstanding. Aluminum is preferred over wood-based materials since rotting is not an issue; and due to the strength of aluminum, the hulls can be made thinner, thereby making the vessel lighter than a wooden structure. Aluminum is preferred over fiberglass in instances where the boat will see rugged service such as in fishing boats. However, the dominate material for recreational boats is fiberglass due to the ability to create highly stylized designs at low cost. Fiberglass boats incorporate hull and deck designs with a high degree of contours which present aluminum boat technology could not affordably replicate. Fiberglass has a disadvantage due to the caustic nature of the chemicals used to make the material and the resulting pollution from the waste chemicals.

Aluminum alloys tend to have limited ductility therefore making formability difficult, thereby making aluminum a less desirable building material when forming is a priority. When forming aluminum alloys, micro and macro cracks can be made which inhere to the boat hull. This can result in weaknesses within the hull that can ultimately result in leakage and water intrusion to the interior of the boat, which is, quite obviously, an undesirable characteristic for a boat hull.

The present invention provides the opportunity to significantly expand on boat hull designs made from aluminum for small to medium sized water vessels. The invention, which is comprised of a plurality of technologies, enables the creation of contours and styling in an aluminum recreational boat at a cost never before available. This low cost highly stylized aluminum boat will offer a consumer a rugged, highly stylized boat which is much lighter than fiberglass boats. The light weight provides considerable savings on propulsion systems when compared to boats constructed of fiberglass. The weight advantage of the present invention eases the trailering requirement often associated with recreational water craft.

A preferred manufacture are pleasure boats within the 15 to 40 foot length from bow to stem, but most preferred is the manufacture of pleasure craft in the 17 to 26 foot length. Pleasure craft can, of course, take many forms, e.g. speed boats, row boats, crew boats, canoes, kayaks, simple motor boats and fishing boats, as well as more exotic jet skis, di- and tri-hulled schooners or catamarans, and platforms.

SUMMARY OF THE INVENTION

What has been found by the present invention is that 6000 series alloys, especially 6022 alloy, comprise the degree of formability that can make interesting and useful boat hull designs without foregoing all of the advantages which reside in the properties of aluminum alloy materials. An example of such a design is shown for the boat B of FIG. 1.

The boat hull is manufactured from stretched formed aluminum alloy, preferably from an AA 6000 series alloy, more preferably from AA alloy 6022. The alloy may be age hardened to have a temper of T4, T6 or O.

DETAILED DESCRIPTION OF THE PREFERRED EMBODIMENTS

The manufacture of the inventive boat is comprised of a mixture of materials, the most important of which is the enabling formability of the 6000 series aluminum alloy. The hull of the boat is manufactured of a thin gauge, high strength tempered alloy which can then be aged at elevated temperatures after forming to achieve a high yield strength of greater than 40 ksi. This minimum yield strength allows the use of thinner hulls than are currently used in pleasure and commercial vessels.

When manufacturing the shape of the hull, conveniently, a stretch forming process is used. Stretch forming means that the aluminum alloy is clamped into a stretcher and extended anywhere from 1 to 15% of its original manufactured length. Current aluminum recreational boats are produced from 5052 aluminum alloy. Stretch forming this alloy will create surface defects known as lueders which are aesthetically rejectionable and therefore commercially unviable. Alloy 6022 does not lueder in the stretch forming operation. The performance of the alloy in stretch forming is an important enabler for a highly stylized and useful aluminum recreational boat. The hulls of this invention are stretch formed and then artificially aged at low temperatures up to their final properties.

Hydroforming may be used to shape a one-piece alloy transom. The forming may be done in a temper, such as T4 or O, and the thusly-formed part is then aged at an elevated temperature with the aluminum alloy hull. Aging together provides a mating of similar strength and form between the transom and the hull.

Stiffness is important in boat hull manufacture. The perception that a boat is rugged and sound is based on the intuitive feel of rigidness in the hull structure. Prior aluminum recreational boats created the rigidity in the structure through the use of a frame assembled from several aluminum extrusions and rolled sections. The cost in material and assembly labor for the frame is roughly 40% of structure cost.

Figure 1:
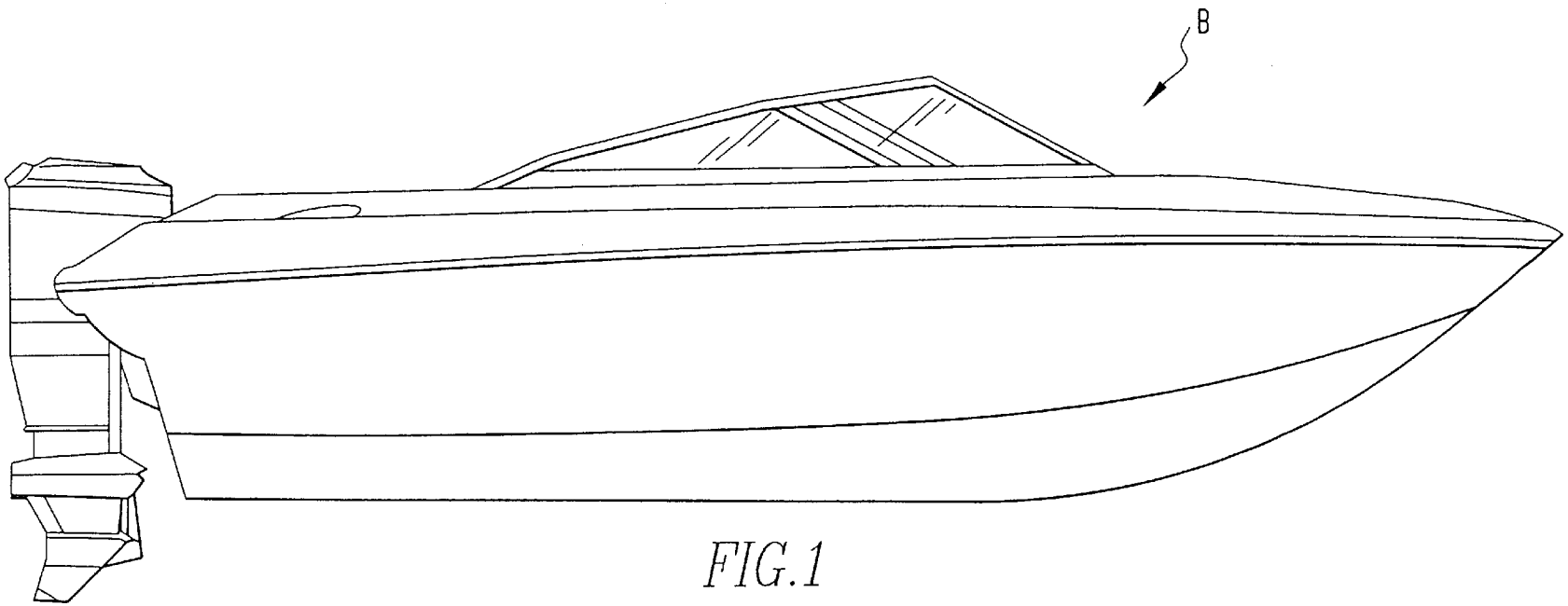
FIG. 1 shows the formability of the preferred alloy incorporated in a small pleasure craft.
Figure 2:
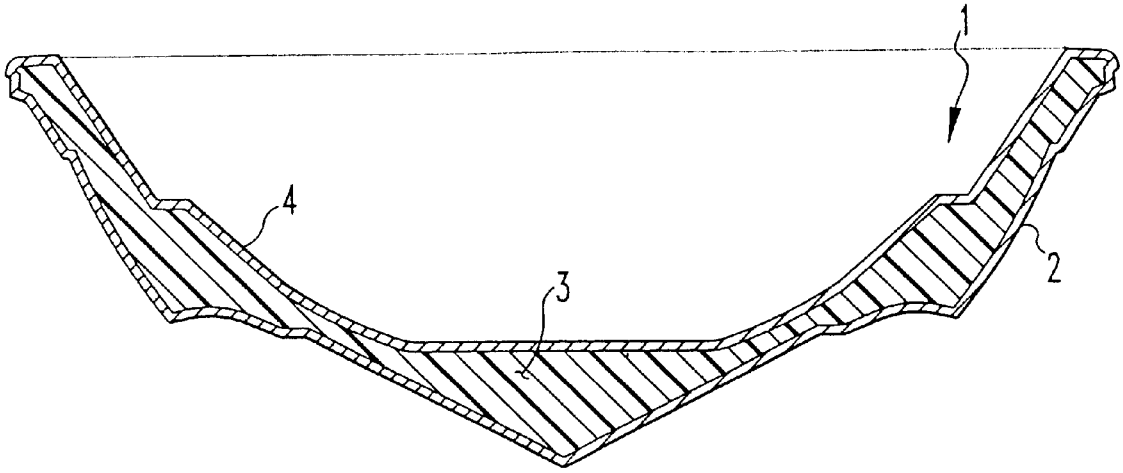
FIG. 2 shows a cross-section of the sandwich construction of one embodiment of the invention.

In one embodiment of the invention shown in FIG. 2, stiffness is achieved in the boat hull 1 by making a sandwich structure of an outer alloy hull 2 and an inner aluminum hull or liner 4 with an intermediate layer of a filler material 3 sandwiched between the hull 2 and the liner 4. Preferably, the outer hull 2 of the boat hull 1 is manufactured from 6022 alloy, the inner hull 4 is manufactured from the same or some other aluminum alloy or a polymer sheet. The intermediate layer 3 between the outer hull 2 and the inner hull 4 may be a polymer material. The polymer material, such as a polyurethane foam, can be used to maintain a separation of the sandwich layers or to extend the metaphor, is the filling between the bread. In this way the inner and outer hull communicate through the filling. Embedded stiffeners in the hull may be optionally employed to add stiffness to the hull structure. Polymer materials may comprise any of the well-known organic polymers such as by way of example the polyethylenes, polypropylenes, polyimides, styrofoam, and the vast amount of co-polymers known to those in the polymer art in sheet, foam, bead, or some other convenient form. Polyurethane is the most preferred of the polymer family in a foamed form.

Figure 3:
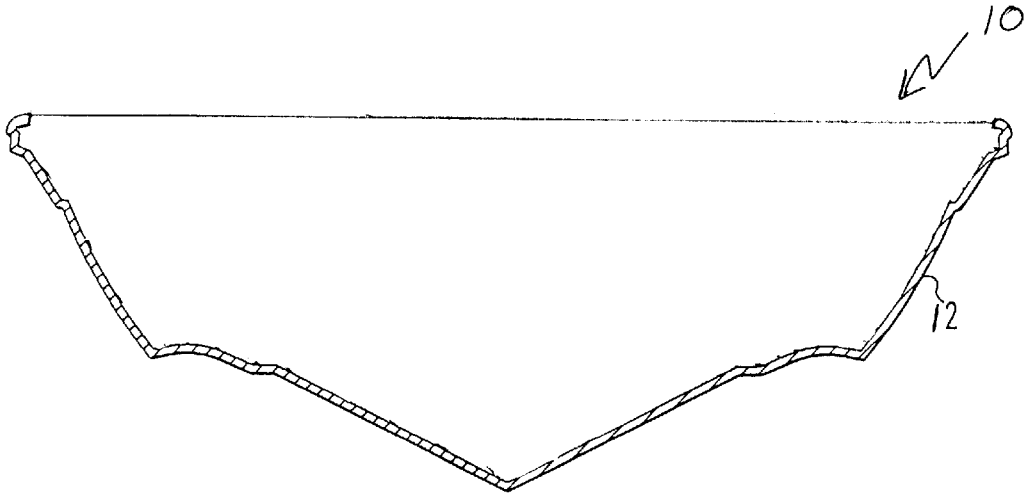
FIG. 3 shows a cross-section of another embodiment of the invention.

In another embodiment shown in FIG. 3, the boat hull 10 may be manufactured from a single hull 12. Preferably, the single hull 12 of the boat hull 10 is also manufactured from 6022 alloy.

In its most preferred embodiment, 6022 alloy of a thin gauge, from 1 to 100 mils, preferably 25 to 50 mils, is formed in the T4 temper and aged at elevated temperatures to provide a yield strength which is greater than 30 ksi, more preferably 40 ksi, to form the hull material. The same 6022 alloy material is hydroformed to manufacture a transom. The formed transom is fabricated in a T4 temper. Both the hull and the transom are then aged at an elevated temperature ranging from 3000 to 500° F., preferably from about 350° to about 400° F. for from about 30 to 60 minutes, but can be aged longer. Other tempers, such as T6, may be employed, but T4 is the preferred temper for formability.

The putative composition of the most preferred 6022 alloy comprises in weight percent about 0.8 to 1.5 silicon, 0.05 to 0.20 iron, 0.01 to 0.11 copper, 0.02 to 0.10 manganese, 0.45 to 0.7 magnesium, no more than 0.10 chromium, no more than 0.25 zinc, and no more than about 0.15 titanium, the remainder aluminum and incidental impurities. Variations of this most preferred composition can be made within the 6000 series alloys with advantageous effects for the import of the present invention in its aspect for formability and design.

An important feature of the application of the 6022 alloy for boat manufacture is its aging at elevated temperatures. This property provides for the simultaneous curability of paints and other surface treatments which enable the inventive aluminum alloy boats to appear other than as aluminum looking boats. Accordingly, thin layers of paint can be cured during the aging of the alloy resulting in the aforementioned increase in yield strength.

The 6022 alloy is a non-luedering alloy which means that the surface of the alloy will maintain a commercial visage after it has been worked, such as by stretching. As a result, stretch forming processes add strength and increase the opportunity for piece count reduction and more design options in shaping the hull surface with fewer joints, connections, and sealants.

We claim:

1. A boat comprising:

a complete outer hull, a complete inner hull and an intermediate layer disposed between said inner and outer hulls, each of said outer hull and said inner hull comprising stretched aluminum alloy, wherein said alloy has a temper selected from the group consisting of T4, T6 and O and said intermediate layer comprises a polymer material.

2. The boat as claimed in claim 1 wherein said stretched aluminum alloy is an Aluminum Association 6000 series alloy.

3. The boat as claimed in claim 2 wherein said stretched aluminum alloy is Aluminum Association alloy 6022.

4. The boat as claimed in claim 1 wherein said polymer material is selected from the group consisting of polyurethane foam, polyethylene, polypropylene, polyimide, and styrofoam.

5. The boat as claimed in claim 1 wherein said stretched alloy is stretched by about 1% to about 15%.

6. The boat as claimed in claim 5 wherein said stretched alloy has a minimum yield strength of 30 ksi.

7. The boat as claimed in claim 1 wherein each of said outer hull and said inner hull has a thickness of about 1 to about 100 mils.

8. The boat as claimed in claim 1 further comprising a transom formed of hydroformed aluminum alloy.

9. The boat as claimed in claim 8 wherein said hydrofonned aluminum alloy is an Aluminum Association 6000 series alloy.

10. The boat as claimed in claim 9 wherein said hydroformed alloy is age hardened.

* * * * *